United States Patent [19]

Milocco et al.

[11] Patent Number: 4,799,855

[45] Date of Patent: Jan. 24, 1989

[54] IMPELLER CONSTRUCTION FOR CENTRIFUGAL PUMP OF TWO-PUMP PUMP UNIT

[75] Inventors: Claudio Milocco; Ugo Favret, both of Pordenone; Antonio Martegani, Trieste, all of Italy

[73] Assignee: Industrie Zanussi S.p.A., Pordenone, Italy

[21] Appl. No.: 115,032

[22] Filed: Oct. 30, 1987

[30] Foreign Application Priority Data

Nov. 27, 1986 [IT] Italy ..... 45753 A/86

[51] Int. Cl.[4] ..... F04D 23/00

[52] U.S. Cl. ..... 415/143; 415/198.1; 416/186 R

[58] Field of Search ..... 415/198.1, 198.2, 143; 416/185, 186 R, 187

[56] References Cited

U.S. PATENT DOCUMENTS

| | | | |
|---|---|---|---|
| 3,099,992 | 8/1963 | La Flame | 415/198.1 X |
| 3,300,122 | 1/1967 | Bowles et al. | 416/186 R X |
| 3,324,796 | 6/1967 | La Flame | 415/198.2 |
| 3,542,496 | 11/1970 | Bergeson et al. | 415/198.2 X |
| 3,583,826 | 6/1971 | Schonwald et al. | 415/143 |
| 3,782,851 | 1/1974 | Hackbarth et al. | 416/186 R X |
| 4,231,706 | 11/1980 | Ueda et al. | 416/186 R |

FOREIGN PATENT DOCUMENTS

| | | |
|---|---|---|
| 860156 | 3/1970 | Italy . |
| 1257101 | 12/1071 | United Kingdom . |

*Primary Examiner*—Robert E. Garrett
*Assistant Examiner*—Joseph M. Pitko
*Attorney, Agent, or Firm*—Wenderoth, Lind & Ponack

[57] ABSTRACT

A pump unit, particularly for use in a dishwasher, includes first and second pumps having respective impellers and a motor drive shaft fixed to the two impellers for alternately rotating the impellers in a first direction, during which only the first pump delivers a liquid, and an opposite second direction during which only the second pump delivers a liquid. The first pump is a peripheral outflow pump, and the second pump is a centrifugal pump the impeller of which includes blades oriented forwardly with respect to the second direction of rotation.

4 Claims, 1 Drawing Sheet

IMPELLER CONSTRUCTION FOR CENTRIFUGAL PUMP OF TWO-PUMP PUMP UNIT

BACKGROUND OF THE INVENTION

The present invention relates to an improved pump unit, particularly for use in a dishwasher, and of the type including a pair of pumps which are operable by a common drive shaft.

A pump unit of this type is known, for example as disclosed in British patent specification No. 1,257,101, wherein the impellers of two separate pumps are keyed to a common drive shaft which is rotatable in opposite directions, such that one of the impellers rotates in a reverse direction when the other impeller is driven in a forward direction, and vice versa. Particularly, one pump is a centrifugal pump of the radial type having backward-oriented blades, and the other pump is of the so-called peripheral outflow or axial-flow type. When employed in a dishwasher, the centrifugal pump circulates water within a wash tub of the dishwasher, and the peripheral outflow pump discharges water from the wash tub.

In this known type of pump unit however, although the pump unit is of advantageously integral construction, it suffers from the drawback that during the water discharge phase, i.e. when the centrifugal pump is rotating in a reverse, non-operating direction, such centrifugal pump consumes a very high level of energy which is substantially wasted. Particularly, the energy consumption of a centrifugal pump of the radial type having backward-oriented blades is higher when its impeller rotates in the reverse direction than when it rotates in the operative, forward direction. It has been experimentally found that during the water discharge phase of the pump unit, the energy consumption of the centrifugal pump will amount to approximately 80% of the overall pump unit energy consumption. As a consequence, the electric drive motor of the pump unit must be undesirably oversized compared with the actual operating, i.e. pumping, requirements. Furthermore, the circulating pump, during the phase in which its impeller rotates in the reverse, nonpumping direction, is a source of hydraulic noise and vibration which should be reduced to a minimum.

It has been suggested, for example as disclosed in Italian No. 860,156, to provide a side wall of the pressure chamber of the centrifugal pump with a curved baffle extending inwardly. The baffle, or similar element, provides that, when the impeller of the centrifugal pump rotates in the reverse direction, a water ring which is formed in the pressure chamber is diverted so as to partially cross the suction inlet of the pump. As a consequence, possible incoming water is ejected through the suction mouth of the pump, whereas the water column at the delivery side reaches only a low level. It has been experienced however that such solution only slightly reduces the above discussed disadvantages. This primarily is due to a braking action which is produced on the impeller of the centrifugal pump by the water ring in the pressure chamber. On the other hand, this solution results in the centrifugal pump being of relatively complicated construction, and additionally provides a relatively limited yield during the regular pumping phases.

SUMMARY OF THE INVENTION

Accordingly, it is an object of the present invention to provide an improved pump unit, particularly useful in a dishwashing machine, which overcomes the above prior art disadvantages. It is a more particular object of the present invention to provide such an improved pump unit which is of simple and integral construction and with which the above disadvantages of wasted energy, hydraulic noise and vibrations are reduced.

The above objects are achieved in accordance with the present invention by the provision of a pump unit including first and second pumps having respective impellers and a motor drive shaft, fixed to the impellers of the two pumps, for alternately rotating the impellers in a first direction, during which only the first pump operates to pump a liquid, and an opposite second direction, during which only the second pump operates to pump a liquid. The first pump comprises a peripheral outflow pump, and the second pump comprises a centrifugal pump the impeller of which includes blades oriented forwardly with respect to the second direction of rotation.

In accordance with a further feature of the present invention, the pump chambers of the first and second pumps are separated by a partition which has therein at least one calibrated opening permanently connecting the pump chambers. As a result, during rotation of the impellers in both the first and second directions fluid flow will be through the calibrated opening in only a single direction from the second pump to the first pump. The calibrated opening particularly may be in the form of an annular opening defined around a hub that is common to both impellers and that extends through the partition.

When the pump unit of the present invention is employed in a dishwasher, the first pump is connected to a water discharge circuit of the dishwasher, and the second pump is connected to a water circulating circuit thereof.

BRIEF DESCRIPTION OF THE DRAWINGS

The above and other objects, features and advantages of the present invention will be apparent from the following detailed description of a preferred embodiment thereof, with reference to the accompanying drawings, wherein.

DETAILED DESCRIPTION OF THE INVENTION

Figure 1:
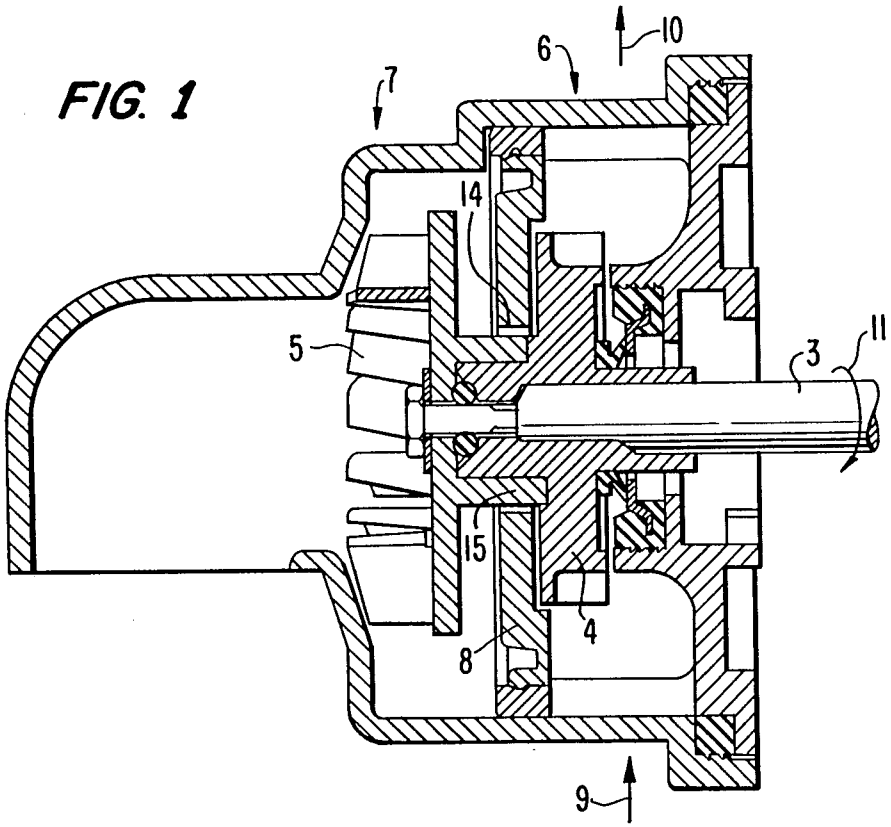
FIG. 1 is a longitudinal sectional view through a pump unit according to a preferred embodiment of the present invention.

With reference to FIG. 1, the pump unit of the present invention includes a housing defining therein pump chambers of first and second pumps 6, 7. An electric motor (not shown) includes a drive shaft 3 rotatable within the housing in opposite first and second directions. Pumps 6, 7 include respective impellers 4, 5 keyed or otherwise fixed to shaft 3 to rotate therewith in the opposite first and second directions. Pumps 6, 7 are separated by means of a partition 8 within the housing. Thus, this results in an integral pump unit construction having the two pumps 6, 7 within a single enclosure and operable by a single drive source.

It particularly is contemplated that the pump unit of the present invention is employable with a dishwasher (not shown) wherein pump 6 is connected to a water discharge circuit for discharging water from a sump of the dishwasher and wherein pump 7 is connected to a water circulating circuit for circulating water to a spraying structure to spray dishes or other articles to be cleaned within the dishwasher.

Figure 2:
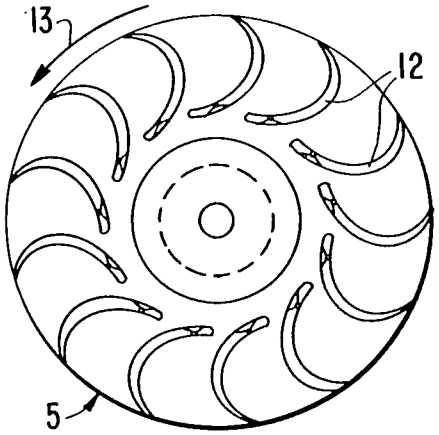
FIG. 2 is a somewhat schematic end view of a preferred arrangement of an impeller of a centrifugal pump employed in the pump unit of FIG. 1.

Impeller 4 of discharge pump 6 is of the peripheral outflow type, known in the art, and capable of pumping fluid, such as dirty dishwasher fluid, from a suction side (indicated in FIG. 1 by arrow 9 and to be connected, for example, with the sump of the dishwasher) to its delivery side (shown in FIG. 1 by arrow 10), when drive shaft 3 is rotated in the first direction, indicated in FIG. 1 by arrow 11. On the other hand, circulating pump 7 is a centrifugal pump and its impeller 5 is shaped as shown in FIGS. 1 and 2. That is, impeller 5 is provided with a plurality of blades 12 which are oriented forwardly with respect to the second direction of rotation of shaft 3. This second direction of rotation is indicated in FIG. 2 by arrow 13 and is opposite to first direction 11.

Attention is directed to the fact that the inlets and outlets or suction sides and delivery sides of the two pumps are indicated only schematically in FIG. 1. However, it is intended that such structural arrangements be conventional and clearly would be understood by one skilled in the art.

Centrifugal pumps provided with impellers having forwarding oriented blades, i.e. pumps of the so-called "action" type, rather than the traditional "reaction" type, previously have been employed only separately, i.e. not in a dual pump unit, and only for specialized applications, for example for providing pressurizing water jets in fire extinguishing equipment, where high-speed water jets are required. It particularly is to be noted that such "action" centrifugal pumps have not in the past been employed in operations wherein their impellers are rotated in the reverse direction, i.e. in a direction opposite to a pumping direction. However, contrary to such prior understanding and uses, the pump unit of the present invention has the surprising effect that energy consumption of the centrifugal pump 7 is particularly reduced when its impeller 5 is rotated in direction 11, i.e. the direction opposite to the normal pumping direction of pump 7. In fact, it has been experimentally determined that when drive shaft 3 is rotated in first direction 11, i.e. when only discharge pump 6 is pumping, the energy consumption of centrifugal pump 7 is lower than 30% of the overall energy consumption of the entire pump unit. Such overall energy consumption is also particularly reduced due to the known characteristics of the peripheral outflow pump 6.

On the other hand, the centrifugal pump 7, of the action type in accordance with the present invention, maintains a high yield even when it is pumping, i.e. when drive shaft 3 is rotated in second direction 13. In the preferred application of the pump unit of the present invention in a dishwasher, during this phase the discharge pump 6 substantially intakes air only, so that its energy consumption is particularly low. Thus, even during a water circulating phase, i.e. a phase when pump 7 is pumping and pump 6 is not pumping, the overall energy consumption of the pump unit according to the present invention advantageously is reduced and is substantially equal to the energy consumption occurring during a water discharge phase, i.e. when pump 6 is pumping and pump 7 is not pumping.

As a result, due to the particular combination of pumps 6, 7 and the particular configuration of impeller 5, it is possible to correspondingly downsize the reversible electric motor, including the overall dimensions thereof. In this connection, the overall dimensions of the pump unit further can be reduced, compared with known such pump units, due to the intrinsic characteristics of centrifugal pump 7 having an impeller of the action type. Thus, it is known that, under the same conditions with regard to rotation speed and hydraulic head, the diameter of the impeller and therefore the overall dimensions of a pump of the centrifugal type having forward-oriented blades are less than those of a centrifugal pump of the radial type having backward-oriented blades.

Furthermore, hydraulic noise and vibrations occurring in the pump unit according to the present invention are reduced to the same extent as is avoidance of wasted energy consumption.

In accordance with a further feature of the present invention, the partition 8 has therethrough a calibrated opening 14 that permanently connects the pump chambers of pumps 6, 7. Particularly, opening 14 is an annular opening defined around a hub 15 that is common to both impellers 4, 5 and that extends through partition 8.

Particularly, opening 14 is predetermined or calibrated with respect to the size of hub 15 and with respect to the designed operating parameters of the pump unit to provide that fluid flow between the two pump chambers always will be in a single direction, i.e. from pump 7 toward pump 6. This is achieved due to the combined action of the two pumps. Thus, when the impellers 4, 5 are rotated in the direction indicated by arrow 13, a flux or flow of fluid through opening 14 from pump 7 to pump 6 is caused by a strong hydraulic head at centrifugal pump 7. On the other hand, when the impellers are rotated in the opposite direction 11, the same flux or flow of liquid through opening 14 from pump 7 to pump 6 is produced by the suction effect of the peripheral outflow pump 6, only a low hydraulic head being present at centrifugal pump 7.

As a consequence of the above advantageous feature of the present invention, particularly when the pump unit is incorporated into a dishwasher, soiled water cannot flow through opening 14 from the water discharge circuit connected with pump 6 to the water circulating circuit connected with pump 7. Rather, the flow will always be in the opposite direction from pump 7 to pump 6. Indeed, the slight flow of clean water from the circulating circuit to the discharge circuit prevents opening 14 from being clogged and additionally enables both the discharge and circulating circuits to be completely emptied during the discharge phase of operation of the dishwasher. This is particularly important when, as is preferable, the discharge and circulating circuits are separated from one another, for instance as described in Italian patent application No. 45740 A/85 filed Sept. 19, 1985, since even in this case there is no need to provide special arrangements for evacuating water from the two hydraulic circuits.

A further advantageous result from the above feature of the present invention that opening 14 provides permanent connection between the pump chambers is that opening 14 essentially replaces a traditional sealing gasket, thereby avoiding the inherent disadvantage of wear of such a gasket.

It is to be understood that although the pump unit of the present invention particularly is useful in a dishwasher, the pump unit of the present invention may be incorporated into other machines, for example a clothes washing machine of the type providing recirculation of an operative liquid.

Although the present invention has been described and illustrated with respect to preferred features thereof, it is to be understood that various modifications and changes may be made to such specifically described and illustrated features without departing from the scope of the present invention.

We claim:

1. In a pump unit including first and second pumps having respective impellers and motor drive shaft means, fixed to said impellers of said first and second pumps, for alternately rotating said impellers in a first direction, during which only said first pump delivers a liquid, and an opposite second direction, during which only said second pump delivers a liquid, the improvement wherein:

said first pump comprises a peripheral outflow pump; and said second pump comprises a centrifugal pump and said impeller thereof includes blades oriented forwardly with respect to said second direction.

2. The improvement claimed in claim 1, wherein said first and second pumps include respective pump chambers separated by a partition having therein at least one permanently open calibrated opening connecting said pump chambers and defining means for passage of water from said pump chamber of said second pump to said pump chamber of said first pump during rotation of said impeller in said first and said directions.

3. The improvement claimed in claim 2, wherein said calibrated opening comprises an annular opening defined around a hub that is common to both said impellers and that extends through said partition.

4. The improvement claimed in claim 1, for use in a dishwasher including a water discharge circuit and a water circulating circuit, further including means for connecting said first and second pumps to the water discharge and water circulating circuits, respectively.

* * * * *